US009114307B1

(12) United States Patent
Rittenberry et al.

(10) Patent No.: US 9,114,307 B1
(45) Date of Patent: Aug. 25, 2015

(54) IN-LAID ATHLETIC FLOOR AND METHOD OF INSTALLING THE SAME

(71) Applicant: Kiefer Specialty Flooring, Inc., Lindenhurst, IL (US)

(72) Inventors: Brion Rittenberry, Gurnee, IL (US); Daniel Kehoe, Gurnee, IL (US)

(73) Assignee: Kiefer Specialty Flooring, Inc., Lindenhurst, IL (US)

( * ) Notice: Subject to any disclaimer, the term of this patent is extended or adjusted under 35 U.S.C. 154(b) by 0 days.

(21) Appl. No.: 14/049,017

(22) Filed: Oct. 8, 2013

(51) Int. Cl.
*A63C 19/00* (2006.01)
*E04F 15/22* (2006.01)
*E01C 3/00* (2006.01)

(52) U.S. Cl.
CPC ..... *A63C 19/00* (2013.01); *E04F 15/225* (2013.01)

(58) Field of Classification Search
CPC ..... E01C 3/00; A63C 19/00; A63C 19/04; A63C 19/02; A63C 19/06; A63C 19/10; A63B 17/00
USPC ..... 472/85–90, 92, 94; 404/32, 33, 34, 37; 473/490
See application file for complete search history.

(56) References Cited

U.S. PATENT DOCUMENTS 1,640,830 A * 8/1927 Hunt ..... 404/34
4,218,059 A * 8/1980 Eiden ..... 473/490
4,429,872 A 2/1984 Capachi
4,879,151 A 11/1989 Ellingson, Jr.
5,093,169 A 3/1992 Sakuraba
5,158,282 A 10/1992 Winter
5,411,352 A 5/1995 Eren
5,897,438 A * 4/1999 Kunz et al. ..... 472/90
5,916,049 A * 6/1999 Wagner ..... 473/490
6,227,989 B1 5/2001 Reid
6,260,326 B1 7/2001 Muller-Hartburg
7,722,287 B2 5/2010 Swank
7,955,024 B2 * 6/2011 Driscoll et al. ..... 404/19
7,958,681 B2 6/2011 Moller, Jr.
8,337,318 B2 12/2012 Oliver
8,353,640 B2 1/2013 Sawyer (Continued)

OTHER PUBLICATIONS

Armstrong Commercial Flooring | "Educational/Institutional—Gymnasium Flooring" webpage as provided by Internet Archive Wayback Machine at <http://web.archive.org/web/20120902031916/http://www.armstrong.com/commflooringna/educational-institutional_gymnasiums-246.jsp>, published on or before Sep. 2, 2012.

(Continued)

*Primary Examiner* — Kien Nguyen
(74) *Attorney, Agent, or Firm* — Benjamin M. Hanrahan; Hanrahan Law Firm, P.A.

(57) ABSTRACT

An in-laid athletic floor and a method of installing an in-laid athletic floor are presented herein. Particularly, the athletic floor is constructed of a plurality of sections comprising an at least partially resilient rubber material and is generally used for athletic activities, including, for example, a number of track and field events, such as running, relay events, hurdles, long jump, triple jump, etc. Specifically, the floor includes a plurality of main floor sections with cut-out gaps or openings there between, and insert floor sections disposed or otherwise in-laid within the gaps or openings. The insert floor sections are positioned within the floor in order to represent or denote various game markings, such as track lane partitions, lane numbering, start and finish lines, relay lines, etc.

17 Claims, 8 Drawing Sheets

(56) References Cited

U.S. PATENT DOCUMENTS

| | | | | |
|---|---|---|---|---|
| 2008/0153609 | A1* | 6/2008 | Kotler | 472/92 |
| 2013/0086861 | A1 | 4/2013 | Masanek, Jr. et al. | |

OTHER PUBLICATIONS

Armstrong Commercial Flooring | "basketball" pdf webpage as provided by Internet Archive Wayback Machine at <http://web.archive.org/web/20140812012433/http://www.armstrong.com/common/c2002/ content/files/71314.pdf> published on or before Sep. 2, 2012.

Mannington Commercial | "Basketball Gym Flooring Kit" pdf webpage as provided by Internet Archive Wayback Machine at <http://web.archive.org/web/20111116020310/http://www.mannington.com/commercial/ assets/pdfs/Literature/GymKit%20Brochure_web%20final.pdf> published on or before Nov. 16, 2011.

* cited by examiner

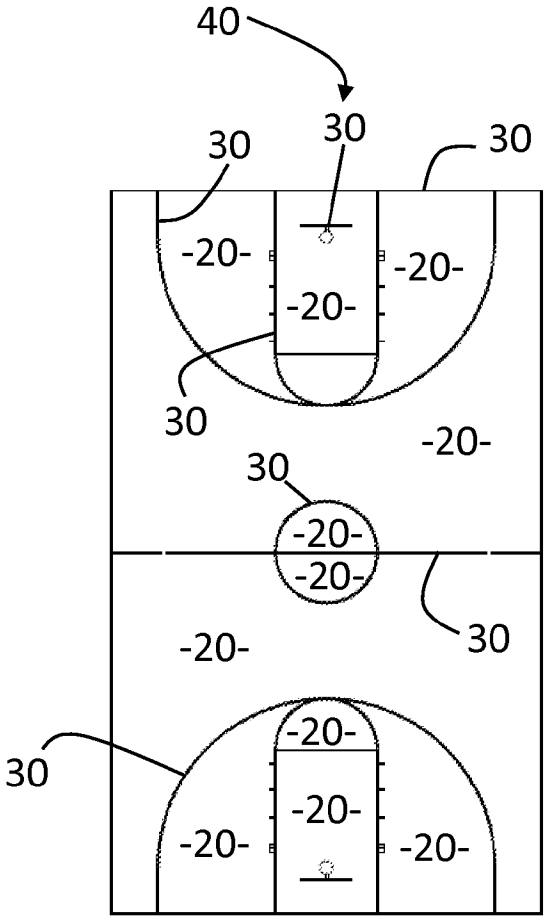
40
30
30
30
30
-20-
-20-
-20-

IN-LAID ATHLETIC FLOOR AND METHOD OF INSTALLING THE SAME

FIELD OF THE INVENTION

The present invention is directed to an in-laid athletic floor and method of installing an in-laid athletic floor. Particularly, the floor of the various embodiments disclosed herein is generally used for athletic activities, including, for example, a number of track and field events, such as running, relay events, hurdles, long jump, triple jump, etc. The floor is constructed of a resilient rubber material, such as, but not limited to, vulcanized prefabricated rubber, and includes a plurality of main floor sections positioned on the support or sub-surface with cut-out gaps, spaces or partitions there between, and insert floor sections disposed or otherwise in-laid within the gaps or openings. For easy visual differentiation, the insert floor sections are generally constructed of a different colored material than the main floor sections, and are positioned within the floor in order to represent or denote various game markings, such as lane partitions, lane numbering, start and finish lines, relay lines, etc.

BACKGROUND OF THE INVENTION

Traditionally, track or other athletic surfaces are installed by attaching the track material to the sub-surface or under layer and then painting the necessary line markings on the top of the track surface. For example, the lane markings, lane numbers, start and finish lines, hurdle markings, relay exchange zones, etc. are denoted via surface paint disposed on the top of the track material.

However, many disadvantages of this process are known, including, for example, the need to periodically repaint the track, for instance, every few years. Particularly, it is common for athletes to wear cleats or shoes with spikes or rough under soles in order for the athlete to maintain traction during the sporting event. As athletes run, walk or otherwise use the athletic surface, the painted-on markings tend to chip, fade, and show spike marks almost immediately. For this reason, and others, the markings must necessarily be repainted periodically in order to maintain their visibility to the athletes, judges and spectators. Furthermore, the painted surface tends to be slippery, especially when exposed to even small amounts of moisture, which can come from weather, spilled water or liquids, and even sweat from the athletes. Specifically, the painted surfaces can create a dangerous and slippery condition for the athletes, which can, in many cases, lead to injury.

It should also be noted that as regulations, including but not limited to those governed by the U.S. Environmental Protection Agency ("EPA"), the United States Green Building Council ("USGBC"), and the South Coast Air Quality Management District ("SCAQMD"), as well as various state and local governments, get more stringent, the paint used to mark track and other athletic surfaces tends to become less effective. For example, there are certain regulations as to the type of paint that can be used to denote game markings in order to protect indoor air quality, for example. However, as the regulations increase or otherwise become more strict or stringent, the paint or materials that can be used becomes less effective and tends to chip off and fade more often, requiring increased maintenance.

Accordingly, there is a need in the art for an in-laid athletic floor wherein the game markings, including the game lines, numbers, etc., are provided via differently colored in-laid floor sections. In this manner, the athletic floor may be devoid of surface paint or otherwise use less surface paint to identify game markings. The resultant floor would be atheistically pleasing, safer for the athletes and require less maintenance.

SUMMARY OF THE INVENTION

The present invention is generally directed to an in-laid athletic floor and method of installing an in-laid athletic floor. Specifically, as will become apparent from the description provided herein, various athletic games, events and sports may be played or performed on the in-laid athletic floor, including, but in no way limited to a number of track and field events, such as long and short distance running, relay events, hurdles, long jump, triple jump, etc.

Furthermore, certain embodiments of the floor of the present invention include a plurality of main floor sections and a plurality of insert floor sections disposed in an abutted or side-by-side relation to one another, wherein the in-laid or insert floor sections are disposed or positioned within the floor in order to represent various game lines, game markings, lane partitions, etc., that may otherwise be painted on the surface of the floor.

Specifically, the floor sections, and in particular, the main floor sections and insert floor sections, are both constructed of a resilient rubber material, such as, but not limited to, vulcanized prefabricated rubber. For easy visual differentiation, the insert floor sections are generally constructed of a differently colored material than the main floor sections. As an example, the main floor sections may be constructed of or otherwise include a green, blue or red material and cover the majority of the floor, whereas the insert floor sections may be constructed of or otherwise include a different color such as white or black in order to identify certain game lines or game markings on the floor. As an example, the game markings may include border lines, lane partitions, start and finish lines, relay exchange zones, lane numbers, long jump fault lines, discus and javelin lines, basketball court lines, volleyball court lines, etc. Of course, other colors and game markings may be included within the full spirit and scope of the various embodiments of the present invention.

Further embodiments of the present invention are directed to a method of installing the in-laid athletic floor described herein. Particularly, in certain embodiments, a first floor member comprising one or more sections of resilient floor material is laid down on the undersurface covering at least a portion of the area in which the floor is to be installed. Next, the first floor member may be cut where the game markings will be and cut out portions of the first floor member are removed. The remaining sections which are not removed define the main floor sections, described above, and the cut out portions are filled with the insert floor sections (preferably of a different color) in order to define the one or more game markings Particularly, the insert floor sections are disposed within the cut out openings and fit in a tight abutted side-by-side relation to the main floor sections. Adhesives or other securing components can be used to secure the sections to the undersurface and/or in the seams between the main and insert sections. The result is a continuous athletic floor with in-laid game lines or game markings.

These and other objects, features and advantages of the present invention will become more apparent when the drawings as well as the detailed description are taken into consideration.

BRIEF DESCRIPTION OF THE DRAWINGS

FIGS. 4B, 4C and 4D are top views of exemplary athletic areas that may be combined as part of a single athletic floor of at least one embodiment of the present invention.

Like reference numerals refer to like parts throughout the several views of the drawings provided herein.

DETAILED DESCRIPTION OF THE INVENTION

As shown in the accompanying drawings, the present invention is generally directed to an in-laid athletic floor 10 and a method 100 of installing an in-laid athletic floor. Particularly, the athletic floor 10 of at least one embodiment is structured for use in one or more various athletic games or events, such as track, running, track and field events, etc. For illustrative purposes only, track and field events may include, but are not limited to, sprints, middle distance runs, long distance runs, hurdles, relay events, long jump, triple jump, high jump, pole vault, shot put, discus throw, hammer throw, javelin throw, etc. Of course, other events or games may be played on the floor 10 and included within the full spirit and scope of the various embodiments of the present invention described herein.

Accordingly, the various floor sections of certain embodiments of the present invention, are generally constructed of an at least partially resilient athletic floor material well-suited for running and other track and field events. Particularly, the floor sections may include rubber, such as vulcanized prefabricated rubber material, which, in some embodiments, provides traction and resiliency for the athletes. In certain implementations, the material or floor sections may include a thickness T of between ¼ of an inch to ¾ of an inch, and preferably between 5/16th of an inch and ½ of an inch or about 13 millimeters. It should be noted that other thicknesses and materials may be used within the full spirit and scope of the various embodiments of the present invention.

Figure 1:
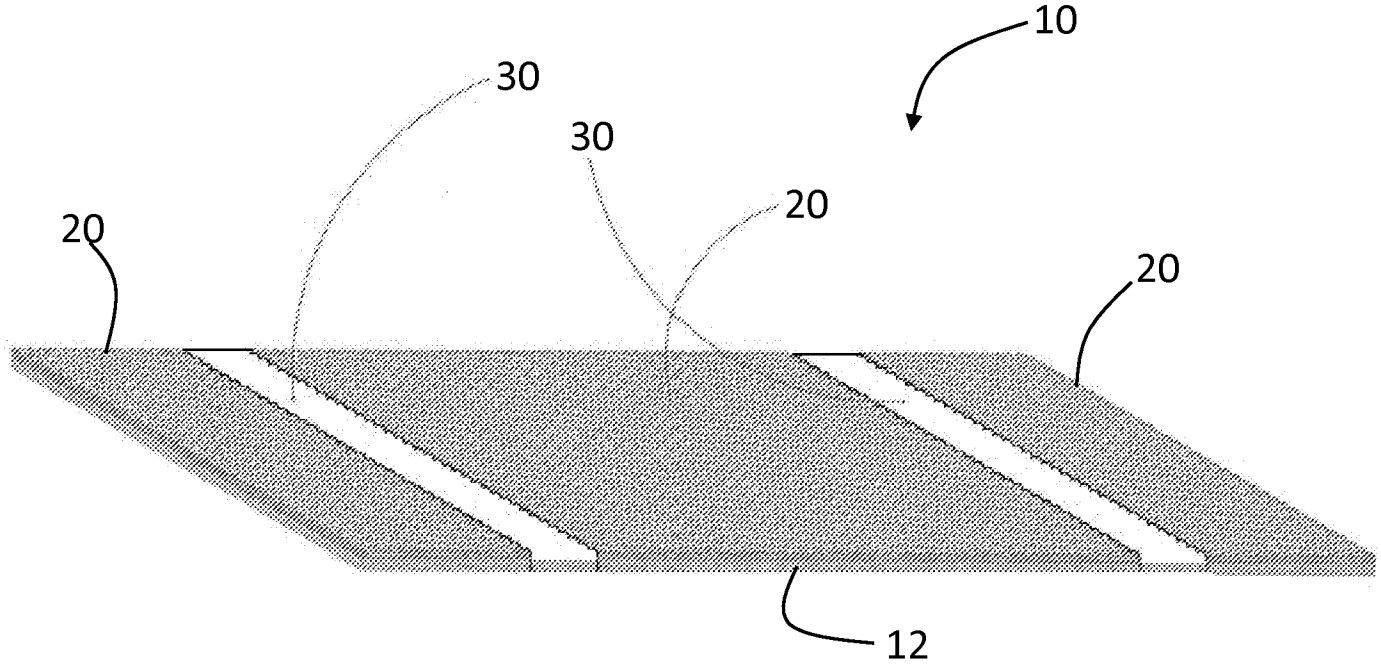
FIG. 1 is a partial cut-away perspective view of a section of the in-laid athletic floor as described in accordance with at least one embodiment of the present invention.

Particularly, referring to the partial cut-away and perspective view of FIG. 1, the in-laid athletic floor 10 of at least one embodiment comprises a plurality of main floor sections 20 and a plurality of insert floor sections 30. As mentioned above, the sections 20, 30 of certain embodiments comprise an at least partially resilient material, including, but not limited to, vulcanized prefabricated rubber.

Specifically, the sections 20, 30 are disposed in an overlying relation to an undersurface 12, which may include virtually any layer or surface, although the under layer or undersurface 12 is commonly a rigid surface such as concrete or a subfloor. It should be noted that an intermediate layer may be disposed between the sections 20, 30 and the undersurface 12 as may be desired or necessary for installation purposes. Furthermore, the sections 20, 30 of the in-laid athletic floor 10 of the present invention may be secured to the undersurface 12 or any intermediate surface via an adhesive component, layer or other substance. It should be noted, however, that certain implementations or installations of the floor 10 of the present invention may be accomplished as a "floating" floor, or otherwise without an adhesive layer or other ways of securing the floor 10 to the undersurface 12.

Figure 2A:
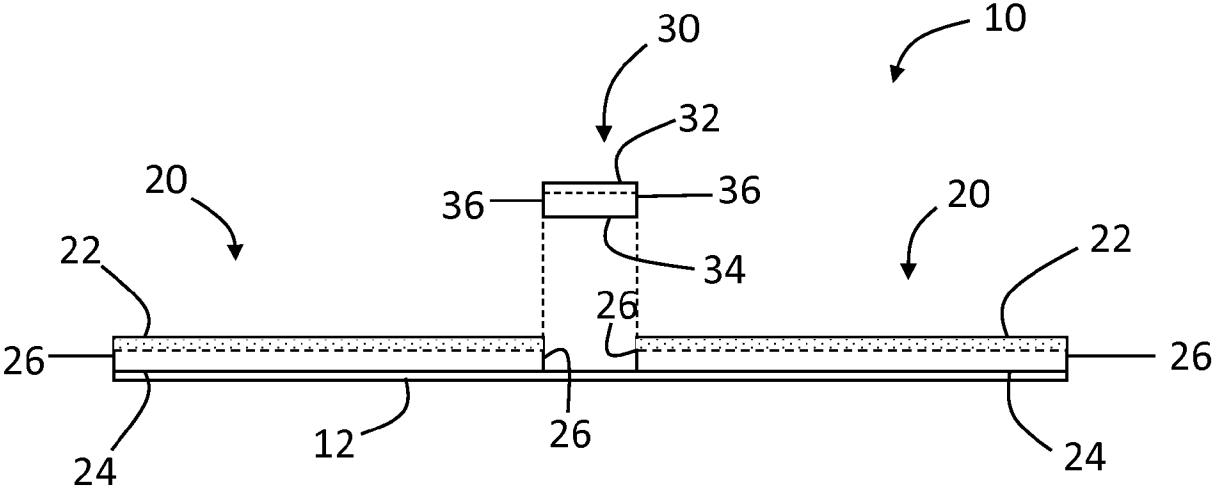
FIG. 2A is a partial exploded view of the in-laid athletic floor of at least one embodiment described herein.
Figure 2B:
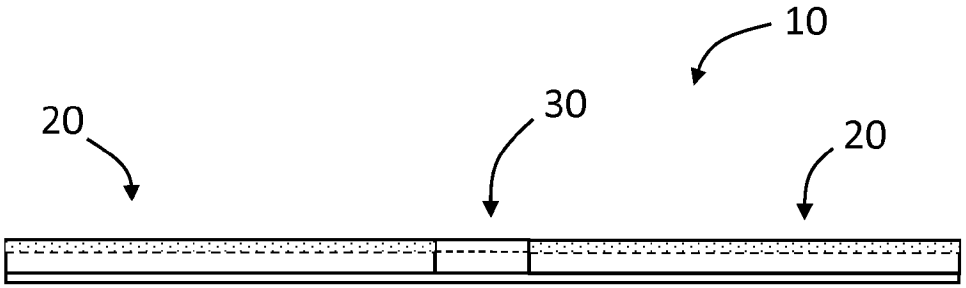
FIG. 2B is a side view of the assembled embodiment shown in FIG. 2A.

Referring now to FIGS. 2A and 2B, the main floor sections 20 of at least one embodiment comprises a top surface 22, a bottom surface 24 and at least one, but more practically, a plurality of side edges 26. Similarly, the insert floor sections 30 of at least one embodiment include a top surface 32, a bottom surface 34 and at least one, but more practically, a plurality of side edges 36.

As illustrated in FIGS. 2A and 2B, the bottom surfaces 24, 34 of the main and insert floor sections 20, 30, respectively, are disposed in an overlying relation to the undersurface 12 and/or any intermediate layer, if included. Particularly, the main floor sections 20 and insert floor sections 30 of at least one embodiment are disposed in a side-by-side relation in that the insert floor sections 30 are "inserted," in-laid, or otherwise disposed between adjacent main floor sections 20. Accordingly, side edges 26, 36 or side seams of adjacently disposed main floor sections 20 and insert floor sections 30 are adjoined or abutted to one another to form a common seam or connection there between. The seams may be filled with adhesive or other components, although it is not necessary in most applications. Rather, the side edges 26, 36 may simply abut one another in a tight fitted manner.

Furthermore, the main and insert floor sections 20, 30 may comprise one or more layers, wherein the top layer or top surface 22, 32 thereof includes the particular or selected color scheme. For example, the color of the top surface 22 or top layer of the main floor sections may be different than the color of the top surface 32 or top layer of the insert floor sections. As described above, this is such that the insert floor sections 30 can denote or represent various game lines on the athletic floor. Moreover, the bottom layer or bottom surface 24, 34 of the various sections may comprise a corrugated or uneven surface (not shown) in order to facilitate adherence to or connection to the support surface or sub-floor 12. It should be noted that a plurality of layers, for example, two, three or more can be implemented.

Figure 3A:
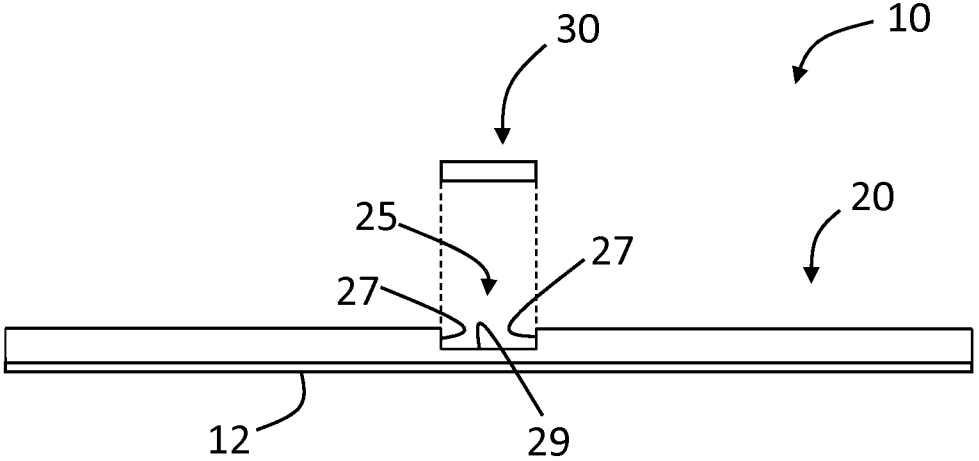
FIG. 3A is a partial exploded view of another embodiment of the in-laid athletic floor of the present invention.
Figure 3B:
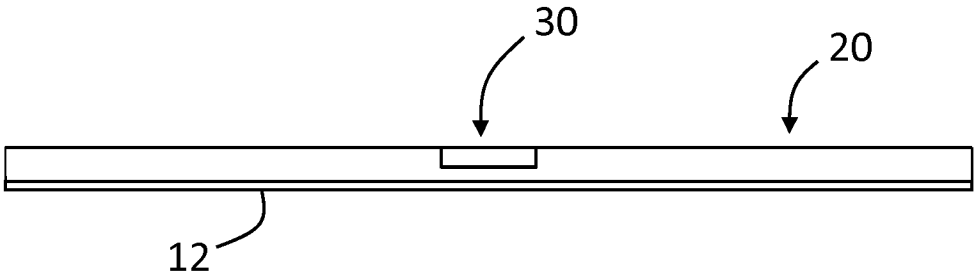
FIG. 3B is a side view of the assembled embodiment shown in FIG. 3A.

Referring briefly to FIGS. 3A and 3B, in at least one embodiment of the in-laid athletic floor 10 of the present invention, the main floor sections 20 may comprise an open portion 25 on the top surface 22 thereof. Specifically, open portion 25 may be defined by interior side edges 27 and an interior bottom surface 29, as shown. Particularly, in such an embodiment, the insert floor section(s) 30 may be disposed within the open portion 25 of the main floor section 20, such that the insert floor section(s) 30 are disposed in an overlying relation to the interior bottom surface 29 of the open portion 25, rather than directly on the undersurface 12.

In any event, the top surfaces 22, 32 of adjacently disposed main floor sections 20 and insert floor sections 30 of at least one embodiment are configured to collectively form a continuous or generally flat surface defining the athletic floor 10. Specifically, the insert floor sections 30 of the various embodiments disclosed in accordance with the present invention are structured and positioned to define a plurality of athletic game lines for the athletic floor 10. More in particular, and for exemplary purposes only, in the embodiment wherein the athletic floor 10 comprises a running track, the insert floor sections 30 are structured to define or otherwise represent certain track markings that may otherwise be represented with paint, such as, for example, track lines or lane partitions defining track lanes, track lane numbers, start and/or finish lines, relay zones or points, etc.

In this manner, the entire track surface or athletic surface of at least one embodiment of the present invention may be constructed of the in-laid athletic floor 10 comprising a plurality of main floor sections 20 and a plurality of insert floor sections 30. For instance, the entire surface may be devoid of surface paint or surface markings which are susceptible to fading or inadvertent removal, for instance, due to normal wear and tear. Particularly, in the event paint or other surface markings are used to define certain game lines, the paint or other surface markings must be reapplied over time in order to maintain the athletic surface and be sure the markings are visible to the athletes, judges and/or spectators. Furthermore, paint and other surface markings tend to be slippery and can therefore create a dangerous condition for the athletes using the field or surface.

Accordingly, the in-laid athletic surface 10 of the various embodiments present significant advantages in the form of longevity and providing a safer playing surface for the athletes. It should be noted, that while some embodiments of the present invention include an in-laid athletic floor 10 completely devoid of paint or other surface markings such that all markings and game lines are defined via the in-laid or insert floor sections 30, some embodiments of the present invention may include some paint or surface markings, if necessary. For instance, it is contemplated that at least some of the game markings are defined by the insert floor sections 30 of the present invention (e.g., lane partitions), while other markings may be painted on the surface.

In order to visually differentiate the main floor sections 20 from the insert floor sections 30, or otherwise, to easily identify where the game lines or game markings are, the main floor sections 30 and insert floor sections 20 of at least one embodiment may be constructed of different colors. For instance, and for illustrative purposes only, the main floor sections 20 and/or the top layer or surface 22 thereof, may comprise a blue, green or red colored vulcanized prefabricated rubber material, whereas the line markings or insert floor sections 30 and/or the top layer or surface 32 thereof comprise a white or black colored vulcanized prefabricated rubber material.

Figure 4A:
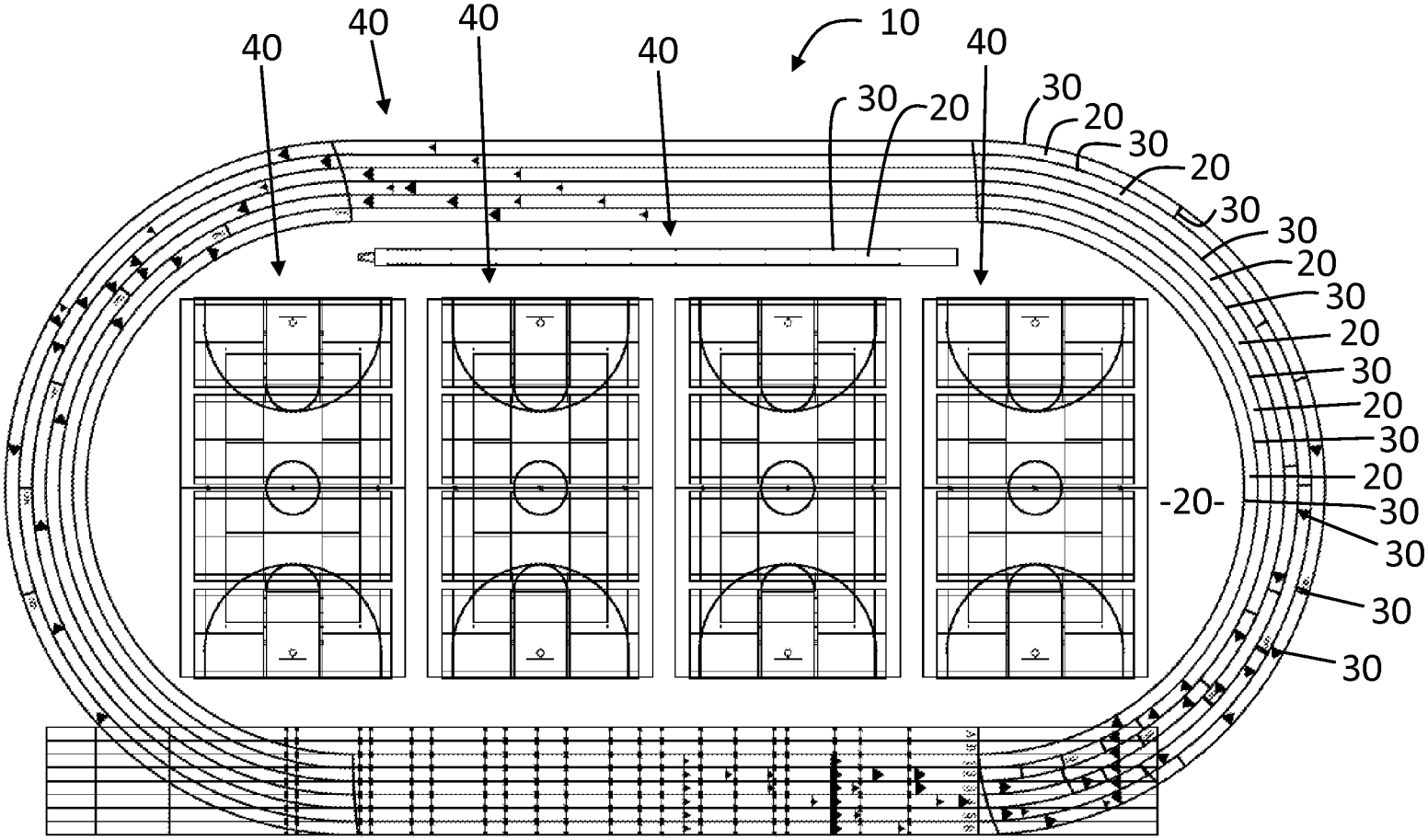
FIG. 4A is a top view of an exemplary athletic floor with a plurality of athletic areas representing areas for different sports, events, and/or games.

Furthermore, as illustrated in FIG. 4A, the in-laid athletic floor 10 of at least one embodiment may be structured to define a plurality of different athletic areas 40. For example, a plurality of different games, events or athletic areas 40 may be disposed or defined on a single or common floor or surface 10. As shown in the exemplary embodiment of FIG. 4A, a single floor 10 may include different areas 40, such as an oval track, various track and field lines associated with different track and field events (e.g., running, hurdles, relays, long jump, triple jump, high jump, pole vault, shot put, discus throw, hammer throw, javelin throw, etc.), one or more basketball courts, volleyball courts, badminton courts, tennis courts, etc. In such a case, the various game lines defining different courts, fields, events, etc., may overlap one another. For instance, the volleyball court may overlap, intersect or share common space with the pole vault lines, and the shot put lines may overlap, intersect or share common space with the long jump lines, as just an example.

For clarity and illustrative purposes only, FIGS. 4B, 4C and 4D show various athletic courts, fields, or areas 40 which can be included in a single athletic floor 10 of the present invention. Particularly, the basketball court of FIG. 4B, the volleyball court of FIG. 4C and the badminton or tennis courts of FIG. 4D can be included in a single athletic floor 10 of the present invention and may overlap each other as shown in FIG. 4A. In this case, the insert floor members 30 which define the various game lines or game markings (including but certainly not limited to lane numbers, triangular markings, etc.) may be constructed of different colors for an athlete, judge and/or spectator to easily identify and differentiate the lines. For instance, the insert floor sections 30 which are used to define the volleyball court lines or other markings may be a different color or pattern than the insert floor sections 30 that are used to define the basketball court lines lines or markings, particularly if the volleyball court and basketball court lines intersect or overlap one another or are otherwise in close proximity to one another.

Figure 5:
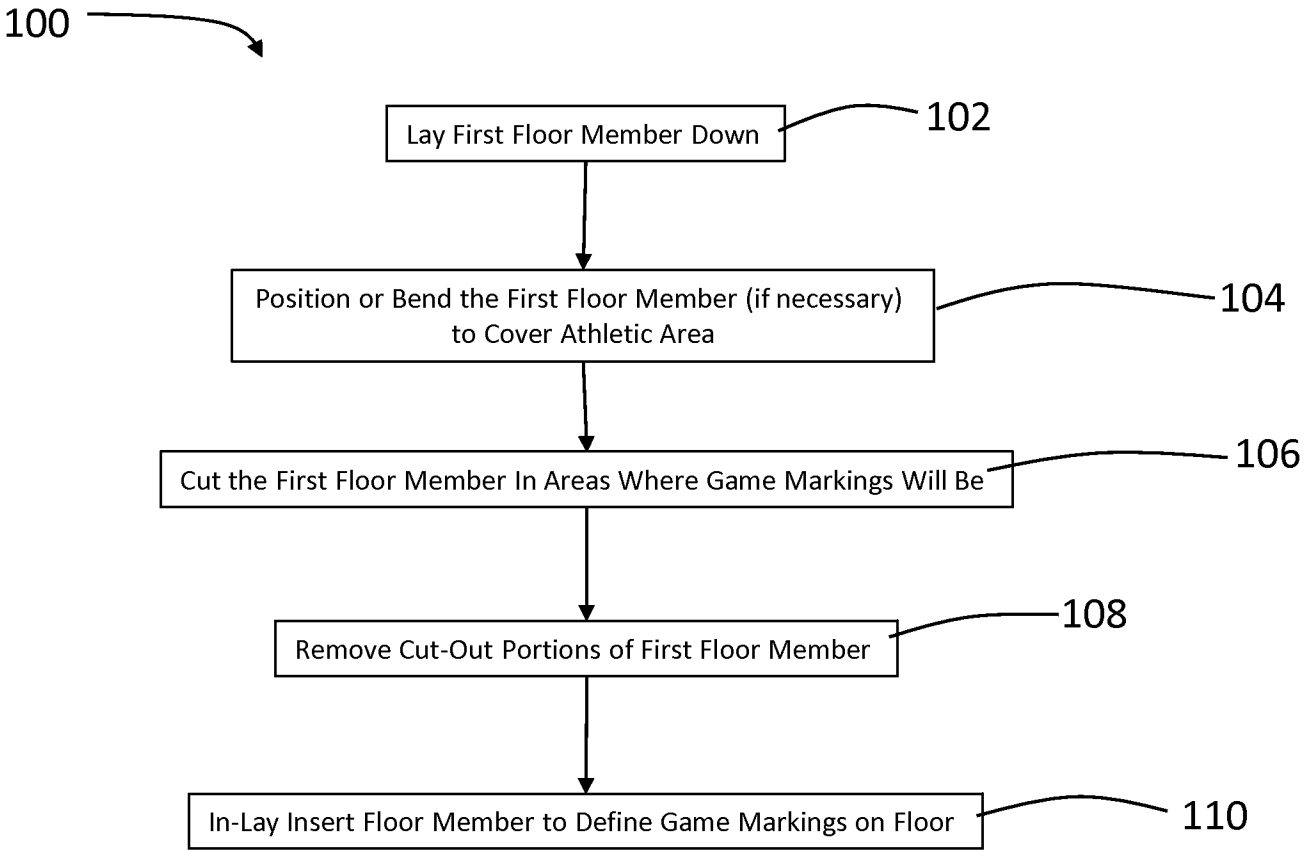
FIG. 5 is a high level flow chart of the method of installing the in-laid athletic floor as described in accordance with at least one embodiment of the present invention.

Referring now to FIG. 5, at least one embodiment of the invention disclosed herein further includes a method 100 of installing an in-laid athletic floor. Particularly, the method 100 comprises the step of disposing a first floor member in an overlying relation to an undersurface, and generally referenced at 102 in FIG. 5. More in particular, the first floor member 50 comprises an at least partially resilient rubber athletic floor material, including, but in no way limited to vulcanized prefabricated rubber. For instance, the undersurface 12 is generally covered by the first floor member 50, and in particular, in the area(s) where the athletic floor is being installed. It should be noted that the installation process or method may include laying a plurality of first floor members 50 in an adjacent side-by-side relation to one another to substantially cover the undersurface or athletic area. Moreover, in certain embodiments, the first floor members 50 may be positioned in a spaced relation to one another in order to allow the insert floor members 30 to be subsequently positioned there between, as described below.

Furthermore, as shown in block 104, certain embodiments of the method 100 further include at least partially adjusting the first floor member 50, if necessary, for example, by bending or turning at least a portion of the first floor member to cover the undersurface defining the athletic area. Specifically, as the first floor member 50 of one embodiment may be constructed of a resilient athletic flooring material, the outermost edges may be bent, or maneuvered in some instances to reach outer portions of the athletic area, to be positioned around curves, or to otherwise fit the material in the athletic area.

Figure 6:
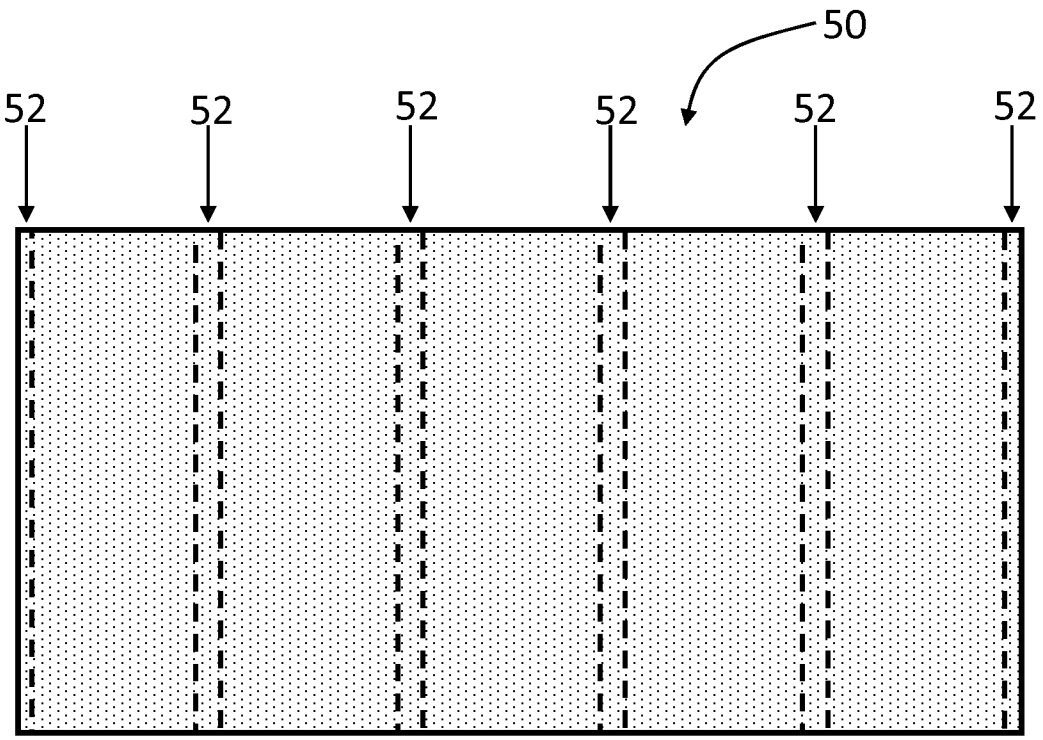
FIG. 6 is a partial cut-away top view of an exemplary embodiment the first floor member and cut-out portions illustrated with broken lines.

Next, in at least one embodiment, the method 100 further includes cutting the first floor member 106 and removing cut out portions thereof 108 in order to define a plurality of main floor sections 20 constructed of the remaining sections of the first floor member. Particularly, portions of the first floor member are cut out and removed, for example, with a knife, utility knife, saw, or other cutting apparatus or machinery. As generally referenced in FIG. 6, cut out portions 52 of the first floor member 50 will represent the portion(s) of the floor where the game lines or game markings of the final floor will be. Further, the pieces or portions of the first floor member 50 that are not removed or cut out define the main floor sections 20, as described above. Specifically, the portions 52 of the first floor member that are removed will subsequently be filled with the insert floor sections 30 to define the game lines, as described herein. More in particular, where traditional paint markings would be to indicate game lines, numbering or markings, the installation process includes cutting and removing those portions of the first floor member 50.

As a non-limiting example, running track lane markings may be two (2) inches wide, and a track lane between the lane markings may be three (3) feet wide, measured from the center of the corresponding lane markings Therefore, a two (2) inch cut out portion may be positioned on opposite sides of a two foot, ten inch strip of a main floor section. Of course, other measurements may be contemplated for each specific installation, and in particular, when game lines for athletic areas other than track lines are implemented.

Figure 7:
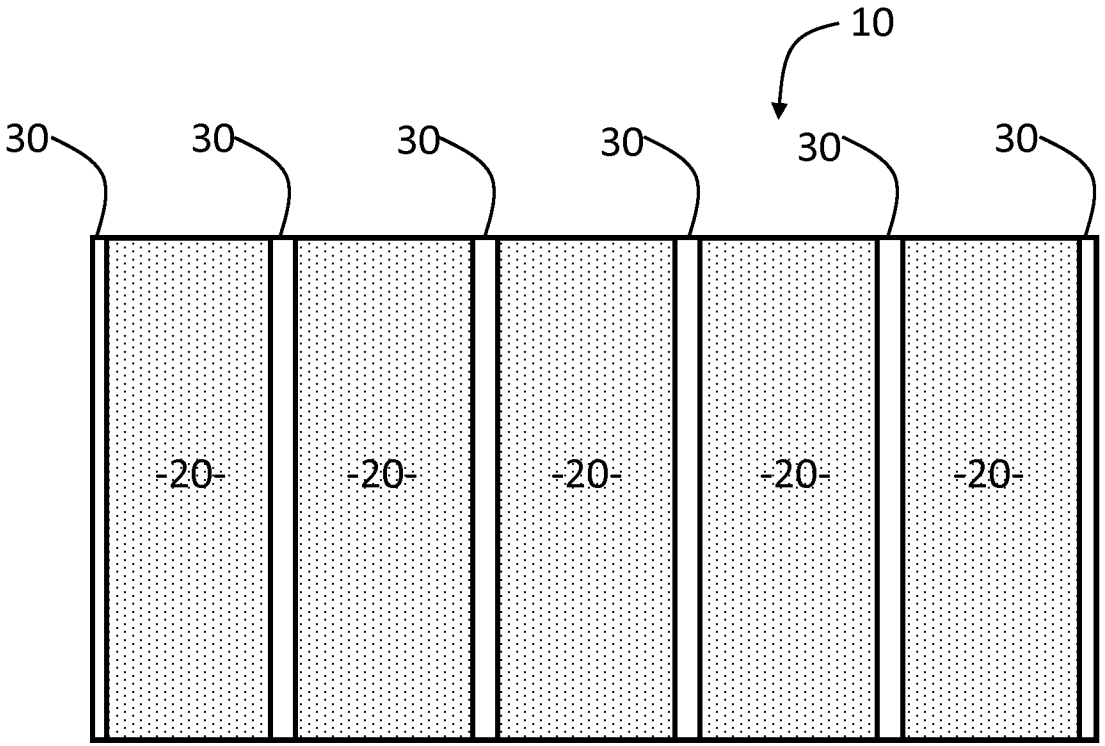
FIG. 7 is a partial cut-away top view of the embodiment illustrated in FIG. 6 with the insert floor sections installed in the cut-out portions.

Turning again to FIG. 5, and particularly at block 110, the method 100 further includes inserting a plurality of cooperatively sized insert floor sections into the plurality of cut out openings. With reference to the example provided immediately above, the insert floor sections may be constructed of a two (2) inch wide strip of material (e.g., at least partially resilient athletic floor material), and inserted into the cut out portions to define the lane markings or lane partitions. Of course, the insert floor sections 30 of the various embodiments may be combined with or inserted between the main floor sections 20 to collectively define virtually any athletic floor surface, wherein the insert floor sections 30 are structured to define the various game lines. As mentioned above, the insert floor sections 30 and/or in-laid game lines or markings are preferably constructed of a different color than the corresponding main floor sections 20 for easy visual differentiation by the athletes, judges and/or spectators. The illustrative example of FIG. 7 shows the floor section of FIG. 6 with the cut out portions filled with the insert floor sections 30.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. An in-laid athletic floor, comprising:

a plurality of main floor sections each comprising a top surface, a bottom surface, and a plurality of side edges, wherein said bottom surface of said main floor sections are disposed in an overlying relation to an undersurface, said plurality of main floor sections comprising an at least partially resilient rubber athletic floor material, a plurality of insert floor sections each comprising a top surface, a bottom surface, and a plurality of side edges, wherein at least one of said side edges of said plurality of insert floor sections is disposed in an abutting relation to an adjacently disposed one of said plurality of main floor sections and said top surface of said insert floor sections and said top surface of said main floor sections collectively define an athletic floor, said plurality of insert floor sections comprising said at least partially resilient rubber athletic floor material, and wherein said plurality of insert floor sections are positioned to define athletic game markings for said athletic floor.

2. The in-laid athletic floor as recited in claim 1 wherein said top surface of said plurality of insert floor sections comprise a different color than said top surface of said plurality of main floor sections.

3. The in-laid athletic floor as recited in claim 1 wherein said athletic floor comprises a running track, and wherein said plurality of insert floor sections are structured and disposed to represent a plurality of track lines defining track lanes.

4. The in-laid athletic floor as recited in claim 3 wherein at least some of said plurality of insert floor sections are structured and disposed to represent a plurality of track lane numbers.

5. The in-laid athletic floor as recited in claim 4 wherein at least some of said plurality of insert floor sections are further structured and disposed to represent a plurality of track and field markings.

6. The in-laid athletic floor as recited in claim 5 wherein said plurality of insert floor sections are positioned between said plurality of main floor sections to define athletic game markings corresponding to a plurality of different athletic areas.

7. The in-laid athletic floor surface as recited in claim 6 wherein said top surfaces of said insert floor sections corresponding to different ones of said different athletic areas comprise a different color.

8. The in-laid athletic floor surface as recited in claim 1 wherein said resilient rubber athletic floor material comprises a vulcanized prefabricated rubber material.

9. A method for installing an in-laid athletic floor, the method comprising:

disposing a first floor member in an overlying relation to an undersurface, the first floor member comprising an at least partially resilient rubber athletic floor material, positioning a portion of the first floor member, if necessary, to cover the undersurface defining an athletic area, cutting the first floor member and removing cut-out portions of the first floor member to define a plurality of main floor sections and a plurality of cut-out openings, each of the main floor sections comprising a top surface, a bottom surface, and a plurality of side edges, and inserting a plurality of cooperatively sized insert floor sections into the plurality of cut-out openings, the plurality of insert floor sections comprising an at least partially resilient rubber athletic surface material, and wherein the plurality of insert floor sections are structured to define athletic game lines for the in-laid athletic floor.

10. The method as recited in claim 9 further comprising defining a top surface of the plurality of main floor sections as comprising a different color than a top surface of the plurality of insert floor sections.

11. The method as recited in claim 10 further comprising defining the top surface of each of the plurality of main floor sections as comprising a common color.

12. The method as recited in claim 11 further comprising defining the in-laid athletic floor as comprising a running track, and wherein the plurality of insert floor sections represent a plurality of track lines defining a plurality of track lanes.

13. The method as recited in claim 12 further comprising defining the plurality of insert floor sections as representing a plurality of track and field markings.

14. The method as recited in claim 13 further comprising defining at least some of the plurality of insert floor sections as representing a plurality of track lane numbers.

15. The method as recited in claim 9 further comprising positioning the plurality of insert floor sections to define athletic game lines corresponding to a plurality of different athletic areas on a common athletic surface.

16. The method as recited in claim 15 wherein the plurality of insert floor sections corresponding to different athletic areas comprise different colors.

17. The method as recited in claim 9 further comprising defining the at least partially resilient rubber athletic floor material as comprising vulcanized prefabricated rubber material.

* * * * *